United States Patent [19]

Murasawa

[11] Patent Number: 5,036,364

[45] Date of Patent: Jul. 30, 1991

[54] IMAGE FORMING APPARATUS INCLUDING DEVELOPER CARRYING MEMBER HAVING REPELLING MAGNETIC BRUSH

[75] Inventor: Yoshihiro Murasawa, Sagamihara, Japan

[73] Assignee: Canon Kabushiki Kaisha, Tokyo, Japan

[21] Appl. No.: 381,307

[22] Filed: Jul. 18, 1989

[30] Foreign Application Priority Data

Jul. 22, 1988 [JP] Japan ..... 63-18249

[51] Int. Cl.[5] ..... G03G 15/09

[52] U.S. Cl. ..... 355/251; 118/658; 355/253

[58] Field of Search ..... 355/260, 245, 251, 253, 355/261, 327, 326; 118/651, 653, 657, 658

[56] References Cited

U.S. PATENT DOCUMENTS

| | | | |
|---|---|---|---|
| 4,436,410 | 3/1984 | Komiya | 355/327 X |
| 4,466,379 | 8/1984 | Nishimura | 118/658 |
| 4,498,755 | 2/1985 | Ohkubo et al. | 118/658 X |
| 4,521,098 | 6/1985 | Hosoya et al. | 355/245 |
| 4,620,783 | 11/1986 | Tanaka et al. | 355/245 X |
| 4,669,852 | 6/1987 | Tajima et al. | 355/253 |
| 4,800,412 | 1/1989 | Ueda | 355/251 |
| 4,814,820 | 3/1989 | Hirahara et al. | 355/253 |

FOREIGN PATENT DOCUMENTS

| | | | |
|---|---|---|---|
| 0170261 | 2/1986 | European Pat. Off. . | |
| 2030288 | 1/1971 | Fed. Rep. of Germany . | |
| 60-112080 | 6/1985 | Japan . | |
| 0127780 | 6/1987 | Japan | 355/251 |

OTHER PUBLICATIONS

European Search Report.
Annex to the European Search Report.

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus is provided with an electrostatic latent image forming member disposed on an image bearing member and developing member for developing the latent image. A developer carrying member is rotatable in a first direction to carry a developer to a developing zone to develop the electrostatic latent image and is rotatable in an opposite direction for a predetermined period when it does not develop the latent image. A stationary magnet is disposed in the developer carrying member. The magnet has a first magnetic pole and a second magnetic pole having the same magnetic polarity at positions downstream of the developing zone with respect to the first direction. The first and second magnetic poles are disposed adjacent to each other, with the second magnetic pole disposed downstream of the first magnetic pole with respect to the first direction. A container is provided for containing the developer to be carried out of the container by the rotation of the developer carrying member in the first direction. The developer is supplied to the developer carrying member in the container at a position downstream of a position where a magnetic force is minimum between the first and second magnetic poles, with respect to the first direction. During the rotation of the developer carrying member in either direction, the developer is removed from the developer carrying member by a repelling magnetic force.

24 Claims, 7 Drawing Sheets

IMAGE FORMING APPARATUS INCLUDING DEVELOPER CARRYING MEMBER HAVING REPELLING MAGNETIC BRUSH

FIELD OF THE INVENTION AND RELATED ART

The present invention relates to an image forming apparatus such as an electrophotographic machine and an electrostatic recording apparatus wherein an electrostatic latent image is formed and is visualized.

In a conventional developing device usable with those apparatuses using two component developer containing magnetic particles (carrier particles) such as iron or ferrite particles and a coloring agent (toner particles), the two component developer is attracted onto a developer carrying member by magnetic force and is formed into a magnetic brush which rubs against a photosensitive member carrying the electrostatic latent image, whereby the latent image is visualized.

An exemplary developing device of this type is shown in FIG. 1. The developing device uses two component developer Do containing magnetic carrier particles having an average particle size of several tens of microns and toner particles having an average particle size from several microns of several tens of microns. The developer Do contained in a developer container 105 is applied in the form of a thin layer by a layer thickness regulating member 100 on a nonmagnetic sleeve 102 rotating in the direction indicated by an arrow and containing therein a stationary magnetic field generating means (magnet) 101. The developer Do, in the form of the thin layer is carried on the surface of the sleeve 102 in the direction indicated by an arrow to a developing zone A where it is opposed to the photosensitive drum 103 rotating in the direction indicated by the arrow and carrying the electrostatic latent image formed. The sleeve 102 is supplied with an AC voltage having a peak-to-peak voltage 2 KV and a frequency of 2 KHz, biased with a DC voltage, from the power source 104. In the developing zone A, the latent image on the drum 103 is visualized by the toner. The developer Do used in the developing action is returned into the developer container 105, and is used for the next development operation. The container is equipped with a stirring means for stirring the developer Do in the developer container 105.

The conventional developing device involves the following problems. The developer Do layer formed on the non-magnetic sleeve 102 is very thin, and the toner in the developer Do is forced to be consumed for the developing action by the AC bias voltage, and therefore, the developer Do after passing through the developing zone is substantially free from the toner. When the developer Do is returned into the developer container 105 and is again formed into the thin layer by the regulating member 100, the toner content in the newly formed developer layer on the sleeve is low. This results in production of a ghost wherein the image density is different in the portion from which the toner has been consumed than in the portion from which the toner has not been consumed.

In an attempt to solve this problem, there are proposals that the stirring power of the stirring means 106 is enhanced and that the degree of packing of the developer Do adjacent the layer thickness regulating member 100 is eased. However, it is still not possible to achieve sufficiently uniform image density.

Since, in the conventional device, the magnetic brush of the developer Do is always in contact with the -photosensitive drum 103, the developer Do is contacted to non-image-area of the drum 103 at the time of the copy starting and ending stage, at which stage the potential of the latent image of the drum 103 is not stabilized. This can result in contamination of the apparatus, and therefore, contamination of the back side of the transfer material and also results in wasteful consumption of the developer. In a multi- or full-color image forming apparatus which has become practically used and which is equipped with plural developing devices, the toner image provided by a certain developing device is disturbed by a magnetic brush of another developing device.

In order to solve this problem, it has been proposed that the thickness of the developer layer on the sleeve is made smaller, in the developing zone, the minimum clearance between the sleeve and the photosensitive member. However, it easily occurs that the toner jumps to the photosensitive member with contamination of the apparatus, and that the color of the toner image already formed is contaminated.

As another measure, it is known that a scraping member selectively contactable to the sleeve is used and that it is press-contacted to the sleeve during non-developing operation to scrape the developer off the developing sleeve to prevent the developer from being supplied into the developing zone. However, this necessitates use of the scraping member with the result of increase of required torque for the sleeve rotation and decrease of the developer conveying power due to damage of the sleeve surface. In addition, since the scraping member is brought into and out of contact with the developing sleeve, additional mechanism is required.

The similar problems arise in the developing devices using one-component developer.

SUMMARY OF THE INVENTION

Accordingly, these principal object of the present invention to provide an apparatus wherein the developer is smoothly removed from the developer carrying member such as a sleeve, and wherein the content of the toner in the developer supplied to the developing zone is maintained constant, and wherein the developer is prevented from being wastefully deposited onto the -photosensitive member during the nondeveloping operation.

It is another object of the present invention to provide an apparatus which can produce a multi-color or full-color images of high quality.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
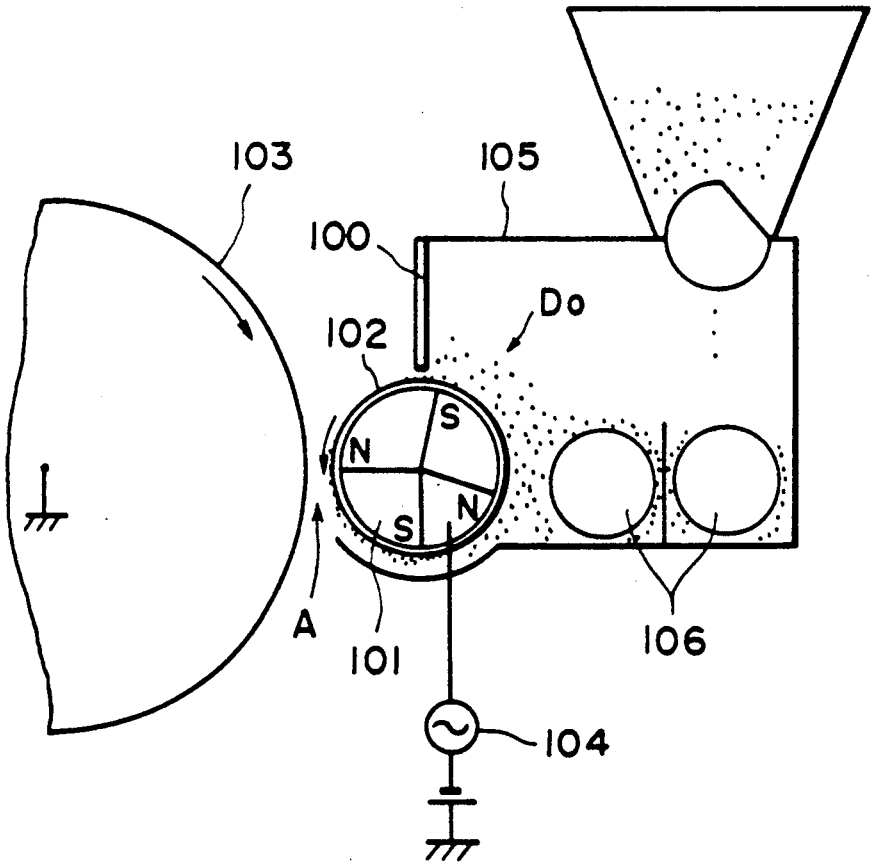
FIG. 1 PRIOR ART
FIG. 1 is a sectional view of a conventional image forming apparatus.
Figure 2:
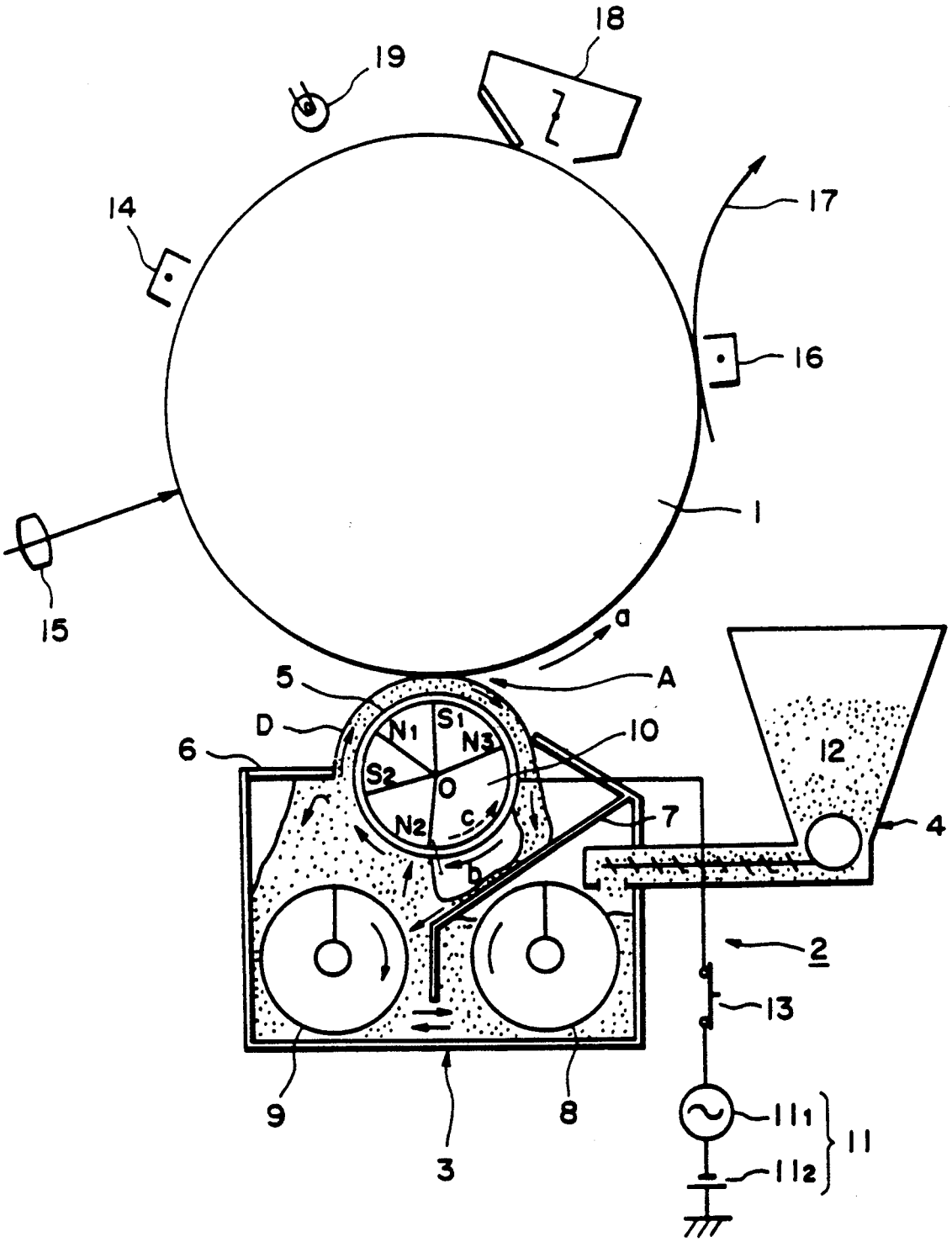
FIG. 2 is a sectional view of an image forming apparatus according to an embodiment of the present invention.

Referring to FIG. 2, there is shown an image forming apparatus comprising a photosensitive drum 1 having a known electrophotographic photosensitive layer made of OPC (organic photoconductor) or the like which is rotatable in the direction of arrow a. In operation, the drum 1 is uniformly charged by charging means 14 such as a corona discharger, and is exposed to original image light through exposure means such as a lens 15 or is exposed to a scanning beam modulated in accordance with image signal, so that an electrostatic latent image is formed on the drum 1. Below the drum 1, there is a developing device 2 in order to develop the latent image. The developed image, that is, the toner image is transferred onto the transfer material 17 by the transfer means such as a transfer charger 16. The toner image transferred onto the transfer material 17 is fixed by an unshown fixing device. After the transfer, the toner remaining on the drum 1 is removed by the cleaning device 18. The electric charge remaining on the drum 1 is removed by a lamp 19 prior to being subjected to the next charging by the charger 14.

The developing device 2 is equipped with a developer container 3 and a hopper 4 communicating therewith.

The container 3 is provided with a developing sleeve (developer carrying member) 5 which is rotatably mounted, a developer layer thickness regulating blade (regulating member) 6 mounted with a small gap between the outer periphery of the developing sleeve 5 and the free edge thereof, a screw (developer conveying and stirring means) 8 rotatably mounted adjacent the bottom of the container 3 and at a side communicating with the hopper 4, and another screw (developer conveying and stirring means) 9 rotatably mounted in parallel with the above-mentioned developer stirring means 8 at a position adjacent the bottom of the container 3 and corresponding to right below the developing sleeve 5.

In the developing sleeve 5, a magnetic roller (magnetic field generating means) 10 is disposed stationarily and coaxially with the developing sleeve 5. The magnetic roller 10 has a diameter smaller than the inside diameter of the developing sleeve 5 and has N-poles and S-poles. The magnetic roller 10 is effective to magnetically attract and retain the developer D on the outer periphery of the sleeve 5 and to form a magnetic brush. During development of the electrostatic latent image, the sleeve 5 rotates in the direction b to carry the two component developer D (mixture of the magnetic carrier and toner particles), out of the container 3 and to carry it into the developing zone. The regulating blade 5 functions at this time to regulate the amount of the two component developer D conveyed out into the developing zone A by the sleeve rotation.

In the developing zone A, the magnetic brush of the developer rubs the photosensitive drum 1. To the sleeve 5, a vibrating voltage provided by a combination of an AC voltage and a DC voltage is applied from the power source 11 as a developing bias voltage. By this, an alternating electric field, that is, an electric field having periodically reversing field direction, is formed across the gap between the drum 1 and the sleeve 5 in the developing zone A, by which the toner and carrier particles are vibrated in the developing zone A to develop the electrostatic latent image. The development of the latent image using the alternating electric field provides a high density developed image without fog. The bias voltage source 11 has an AC source $\mathbf{11}_1$ for supplying an AC voltage in the form of a sine, rectangular, triangular or the like wave having a frequency of 1-3 KHz and a peak-to-peak voltage of 1-3 KV, and a DC source $\mathbf{11}_2$ for supplying a DC voltage having a voltage level between the maximum potential of the latent image (dark portion potential) and the minimum potential thereof (light portion voltage). The maximum potential and the minimum potential of the latent image are both between the maximum voltage and the minimum voltage of the vibrating voltage.

It is preferable that the minimum gap between the drum 1 and the sleeve 5 is 0.3-0.8 mm in the developing zone, and that the thickness of the developer layer in the developing zone A is 0.8-2.0 mm when measured without the drum 1. The thickness of the developer layer in the developing zone A may be smaller than the minimum gap between the drum 1 and the sleeve 5.

The developing bias source 11 may include a DC source $\mathbf{11}_2$ only without the AC source $\mathbf{11}_1$. However, in the device using the above-described thin developer layer, it is preferable in order to enhance the developing power to use the vibrating bias voltage.

A switch 13 is provided to selectively apply the developing bias voltage to the sleeve 5 from the source 11. When the switch 13 is closed, the voltage is applied to the sleeve 5.

The developer conveying and stirring means 8 stirs the non-magnetic toner 12 supplied from the hopper 4 through the communicating portion and the magnetic carrier stagnating in the container 3, thus conveying them to the conveying and stirring means 9 with good condition of mixture maintained. The developer conveying and stirring means 9 is driven in the manner similar to the developer conveying and stirring means 8 and stirs the two-component developer stagnating in the developer container 3 and the two-component developer removed from the sleeve and traveled down on the partition wall 7, thereby to supply the developer to the developing sleeve with good mixture condition maintained. The conveying and stirring means 9 supplies a part of the developer to the conveying and stirring means 8. The partition wall 7 is provided between the developing sleeve 5 and the developer conveying and stirring means 8 and is inclined at a predetermined angle relative to the vertical line. It is effective to guide the developer removed from the sleeve 5 toward the stirring means 9.

The description will be made as to the disposition of the magnetic poles of the magnet roll 10 within a sleeve 5. As shown in FIG. 2, the developing pole S1 disposed in the developing zone A is faced through the sleeve to the photosensitive drum 1 to form a magnetic brush of the developer erecting from the surface of the sleeve 5 in the developing zone.

Downstream of the developing zone A with respect to the rotational direction of the sleeve 5, adjacent magnetic poles N3 and N2 having the same magnetic polarity are disposed. Those magnetic poles N3 and N2 form a so-called repelling magnetic field therebetween. The repelling magnetic field is such a magnetic field that the magnetic lines of force extending from those magnetic poles are repelling at a position between the magnetic poles. In such a repelling magnetic field, it is extremely difficult for the developer to transfer from the one magnetic pole to the other magnetic pole.

The angle formed between the magnetic poles N2 and N3 seen from the center of the magnet roll 10 (the angle between lines N2-O and N3-O) is preferably 60–180 degrees, and further preferably not less than degrees, from the standpoint of good magnetization. The magnetic flux density on the sleeve surface at a position B (see FIG. 3) between the magnetic poles N3 and N2, at which the density of the magnetic flux in a direction normal to the sleeve surface is minimum, is preferably not more than 50 Gausses, further preferably substantially 0 Gauss. The magnetic force at the position B preferably has the magnetic force of the same polarity as the magnetic poles N3 and N2.

With respect to the rotational direction of the sleeve 5, the magnetic pole S2 is disposed downstream of the magnetic pole N2, and the magnetic pole N1 is disposed downstream of the magnetic pole S2. The magnetic poles S1 and S2 have the S-polarity, and the magnetic poles N1, N2 and N3 have the N-polarity, but they may be of the opposite polarities. From the standpoint of good conveyance of the developer and good prevention of scatter, the magnetic flux density in the normal direction on the sleeve surface for the respective magnetic poles is preferably not less than 500 Gausses.

Figure 3:
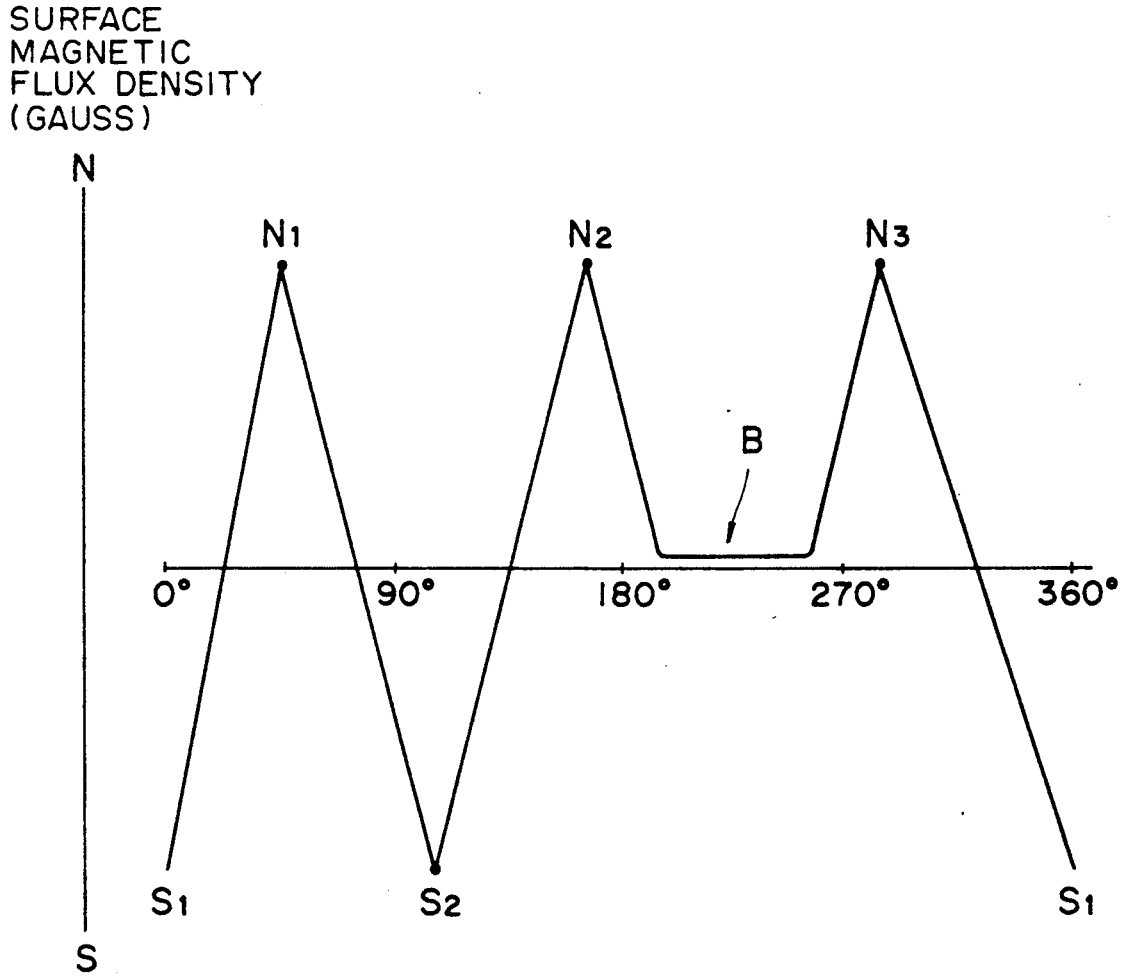
FIG. 3 illustrates magnetic flux density distribution on a surface of a sleeve used in FIG. 2 apparatus.

FIG. 3 shows a relation between the magnetic flux density and an angular position on the developing sleeve 5 seen from the center, that is, a magnetic flux density distribution or profile. As will be understood from this Figure, by disposing the magnetic poles of the magnetic roller 10 in the manner shown in FIG. 2, the developer D regulated by the regulating blade 6 moves in the direction of the arrow D (clockwise direction) while being retained on the sleeve 5 by the magnetic force of the magnetic poles N1, S1 and N3. However, after passing through the developing zone A, the developer separates from the sleeve surface at the position B between the repelling magnetic poles N2 and N3 because the magnetic attraction force to the sleeve surface is very small or zero there. The separated developer D moves down on the wall 7 inclined relative to the direction of the gravity to the developer conveying and stirring member 9. From the developer conveying and stirring member 9, the stirred and mixed developer D is newly supplied to the developing sleeve 5 by the magnetic attraction force of the magnetic poles N2 and S2. In the container 3, it is preferable that the developer is supplied to the developer 5 at a position downstream of the position B where the magnetic flux density is minimum in the region between the magnetic poles N3 and N2 with respect to the rotational direction of the sleeve 5. The position where the developer is separated from the sleeve 5 by the repelling magnetic field formed by the magnetic poles N3 and N2 is preferably within the container 3.

On the other hand, when the developing 5 operation is not performed, the developing sleeve 5 is rotated in the reverse direction, that is, in the counterclockwise direction c through a predetermined number of revolutions. During this rotation, the developer D in the container 3 is not transferred from the magnetic pole N2 to the magnetic pole N3 due to the repelling magnetic field, and in addition, the developer D is not, supplied to the sleeve 5 at a position within the container 3 downstream of the minimum magnetic force position B between the magnetic poles N2 and N3 with respect to the direction c, and therefore, the developer is not present on the sleeve surface advancing toward the developing zone A. The rotation of the sleeve 5 in the direction c is stopped when the surface free from the developer layer is faced to the photosensitive drum 1 in the developing zone A.

Figure 4:
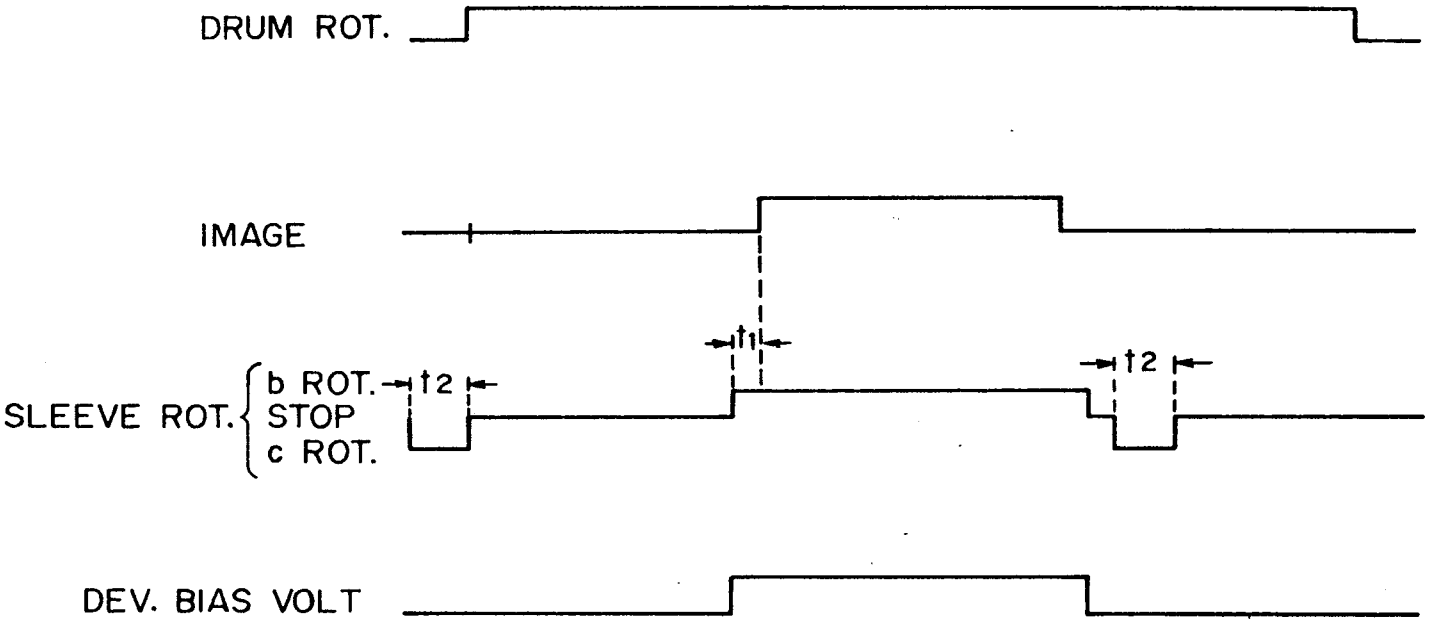
FIG. 4 is a timing chart for the operation of FIG. 2 apparatus.
Figure 6:
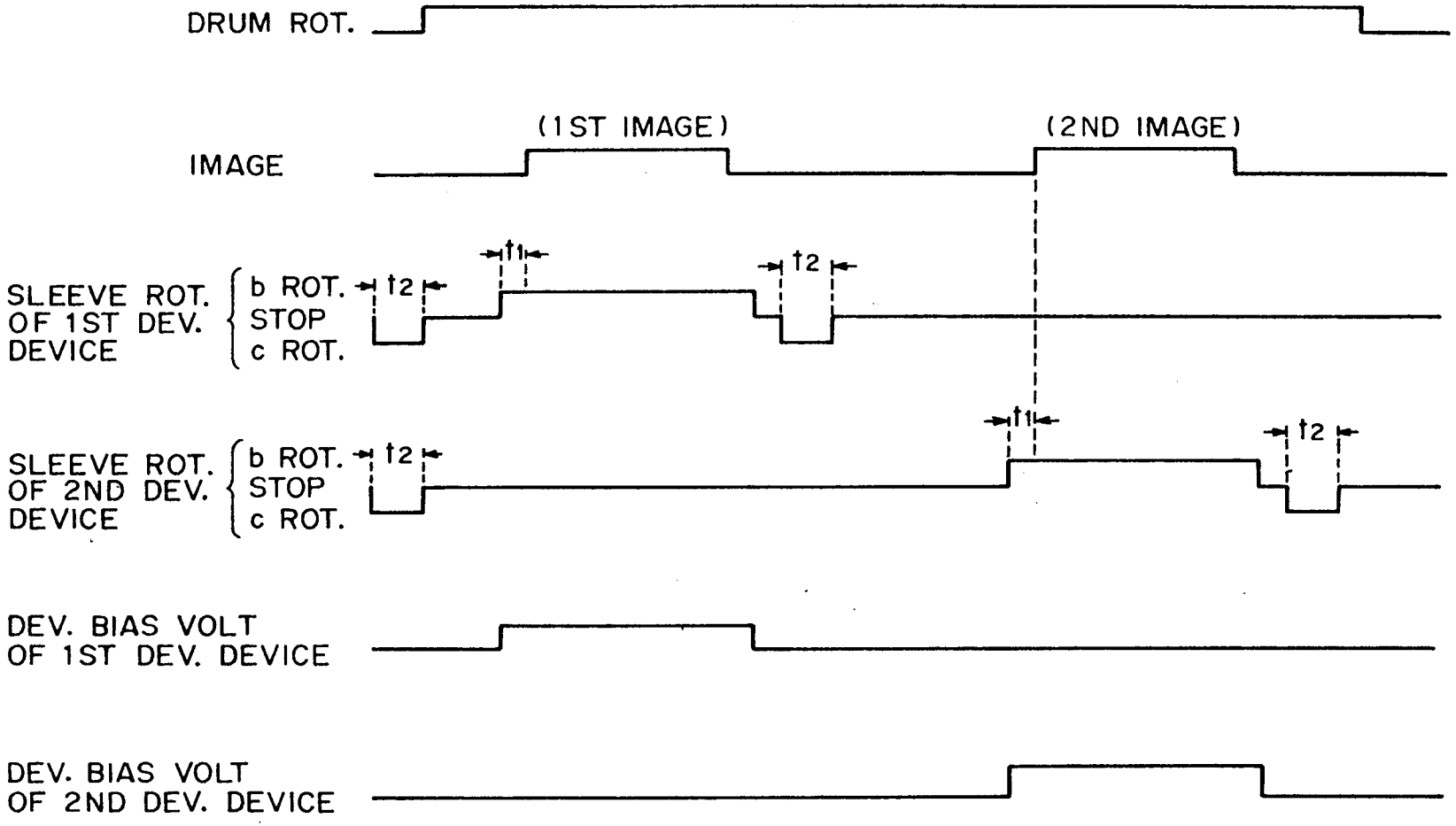
FIG. 6 is a timing chart for operation of FIG. 5 apparatus.

In this embodiment, the developing sleeve 5 is driven by a sleeve driving motor (not shown) capable of driving it in the b direction and c direction. The image forming operation is performed in the sequence shown in FIG. 4. Before the start of the rotation of the photosensitive drum 1, the sleeve 5 is rotated for the time period $t_2$ in the counterclockwise direction c to provide the sleeve 5 surface free from the developer D in the developing zone A. The time period $t_2$ is determined such that the sleeve rotates through one half to one turn. The sleeve 5 is rotated in the clockwise direction b at a point of time which is prior to the start of the development of the latent image by a time period $t_1$, by which the thin layer of the developer D is formed on the sleeve 5. The rotation of the sleeve in the direction b is continued to develop the latent image. The time period $t_1$ is larger than the time required for sufficient formation of the thin layer of developer D. The sleeve 5 continues to rotate in the direction b at least until completion of the development of the latent image. It is preferable that the sleeve 5 is rotated in the direction b a short period after completion of the development of the latent image. Simultaneously with or a short period after stoppage of the sleeve 5 rotation in the direction b, and before the next latent image reaches the developing zone Z, the sleeve 5 is rotated in the counterclockwise direction c for a period of time $t_2$ so as to provide the sleeve 5 surface free from the developer D in the developing zone A. In FIG. 4 and FIG. 6 which will be described hereinafter, the upper level of the line indicating "image" means that a latent image is passing through the developing zone.

With respect to the rotational direction of the sleeve in the direction b, the magnetic pole S2 is upstream of the blade 6, and the magnetic pole N1 is downstream of the blade 6. The polarities of the magnetic poles S2 and N1 are opposite. Therefore, the magnetic poles S2 and N1 form a magnetic field effective to permit the developer to pass through the gap between the blade 6 and the sleeve 5 into the container 3 when the sleeve 5 is rotating in the direction c. Because of this, even when the sleeve 5 is rotated in the direction c, the developer is prevented from being blocked by the blade 6 to overflow outside the developing device.

It is further preferable in order to further prevent wasteful deposition of the toner and carrier particles onto the drum 1 that the switch 13 is closed and opened in synchronization with the start and completion of the sleeve 5 in the direction b by which the sleeve 5 is supplied with the above-described developing bias voltage only during the rotation of the sleeve 5 in the direction b. However, it is possible that the sleeve 5 is supplied with the developing bias voltage always when the drum is rotated.

Figure 5:
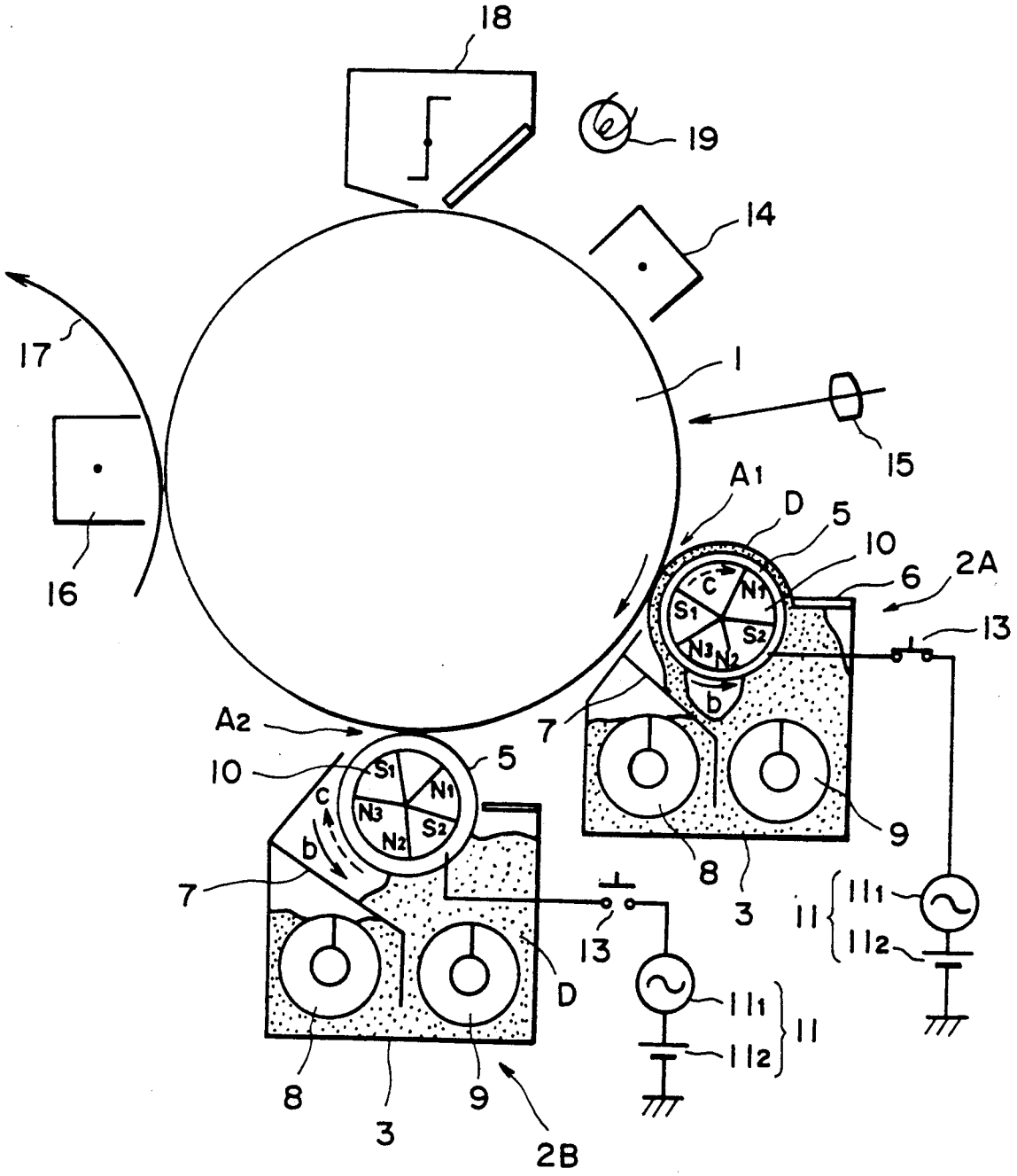
FIG. 5 is a sectional view of an image forming apparatus according to another embodiment of the present invention.

FIG. 5 shows another example wherein the present invention is applied to a multi-color image forming apparatus. In this embodiment, a first developing device 2A and a second developing device 2B containing different color developers, respectively, are disposed around the photosensitive drum 1. The structure of each of the developing devices 2A and 2B is similar to the described in conjunction with the FIGS. 2 and 3, and therefore, the detailed 5 description is omitted (the developing device is 2A and 2B of FIG. 5 are shown in an inverted fashion from the developing device of FIG. 2).

The latent image to be developed in a first color is developed by the first developing device 2A, and at this time, the developing action of the second developing device 2B is not performed. The latent image to be developed in the second color is developed by the second developing device 2A, and at this time, the developing action of the developing device 2A is not performed. In FIG. 5, the first developing device 2A is shown as performing the developing action, while the second developing device 2B is not operated.

Referring to FIG. 6, the description will be made as to the sequential operations for first developing the first latent image by the first developing device 2A and then developing the second latent image by the second developing device 2B. Prior to the start of the copying process (start of the photosensitive drum rotation), the sleeve of each of the developing devices is rotated in the direction c for the time period $t_2$, by which the developer is removed from the developing zones A1 and A2 of the first and second developing devices 2A and 2B, respectively.

The sleeve 5 of the first developing device 2A is started to rotate in the direction b $t_1$ prior to arrival of the first latent image in the developing zone A1 of the first developing device 2 of the first developing device 2A to develop the first latent image. After completion of the first latent image, the sleeve 5 of the first developing device 2A is rotated in the direction c for the time period $t_2$ to remove the developer from the sleeve 5 to provide the developer free surface of the sleeve in the developing zone A1. During this period, the second developing device 2B maintains the developer free condition in the developing zone A2 of the second developing device 2B so as not to disturb the first image developed by the first developing device 2A. Then, the sleeve 5 of the second developing device 2B is started to rotate in the detection b $t_1$ prior to arrival of the second latent image in the developing zone A2 of the second developing device 2B, so as to develop the second latent image to develop the second latent image. After completion of the first latent image development, the sleeve 5 of the second developing device 2B is rotated in the detection c for the time period $t_2$, by which the developer is removed from the sleeve 5 so as to provide the developer layer free surface in the developing zone A2. During this period, the first developing device 2A maintains the developer free state in the developing zone A1 of the first developing device 2 so as not to disturb the second image developed by the second developing device 2B.

During the first latent image, the switch 13 of the first developing device 2A is closed, while, on the other hand, during the development of the second latent image, the switch 13 of the second developing device 2 is closed, so that the developing bias voltage is applied to the respective sleeves 5.

In this example, on the first image developed by the first developing device 2A, the second latent images overlaid, by which an image of a combination of the first and second images is formed on the photosensitive drum, and is transferred as a whole onto the transfer material 17. Therefore, the cleaning device 18, is retracted from the drum 1 to become inoperative during the passage of the first image through the cleaning station. After the first image passes through the cleaning station, the cleaning device 18 is brought into contact with the drum 1 to start the cleaning operation.

The present invention is applicable to an image forming apparatus wherein after the first image is transferred onto the transfer material, the second image is transferred onto the same transfer material or another transfer material.

The present invention is applicable to the image forming apparatus using three or more developing devices containing different color developers.

Also, the present invention is applicable not only to an image forming apparatus as shown in FIG. 5 wherein the plural developing devices are stationarily disposed around the photosensitive drum, but also to an image forming apparatus wherein plural developing devices are mounted on a movable supporting frame, and a selected developing device is moved to the neighborhood of the photosensitive drum, as shown in U.S. Pat. No. 4,743,938. In this case, the developing zone for supplying the developer to the photosensitive member is common for all the developing devices.

Figure 7:
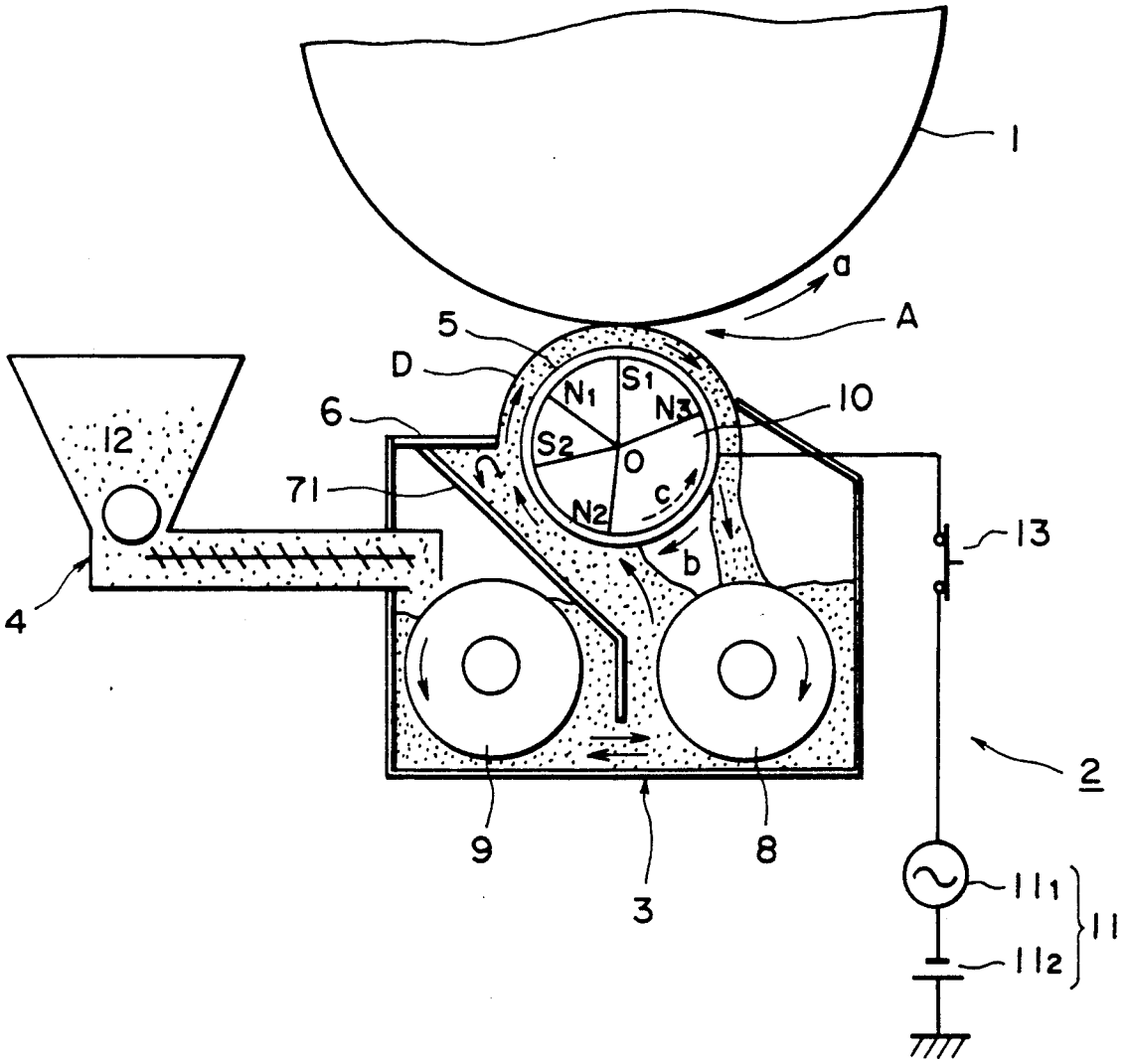
FIG. 7 is a sectional view of a part of an image forming apparatus according to a further embodiment of the present invention.

In the foregoing embodiments, the developer separated from the sleeve 5 by the repelling magnetic field provided by the magnetic poles N3 and N2 is guided by the partition wall or plate 7 toward the stirring means 9, but in the example of FIG. 7, the developer separated from the sleeve 5 by the repelling magnetic field falls to the conveying and stirring means 8. The developer having fallen is stirred by the stirring means with the developer stagnating in the container. The developer is supplied to the sleeve 5 by the stirring means 8, and the developer is retained on the sleeve 5 by the magnetic force provided by the magnetic poles N2 and S2 and is conveyed to the blade 6. The stirring means 9 is supplied with the toner from the hopper 4, and is stirred and mixed with the developer stagnating in the container 3. A developer guiding partition plate 71 functions to provide a partition between the sleeve 5 and the stirring means to make smoother motion of the developer between the magnetic pole N2 and the blade 6.

In FIGS. 2 and 7, the arrow added in the developer D indicates motion of the developer.

In the foregoing embodiment, the two component developer containing carrier particles and toner particles is used, but the present invention is applicable to a one component developer not containing the carrier particles. In this case, the toner is magnetic. The direction of the peripheral movement of the sleeve during the developing operation may be opposite to the direction of the peripheral movement of the photosensitive member in the developing zone.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming an electrostatic latent image on said image bearing member; and developing means for developing the latent image, said developing means comprising:

a developer carrying member rotatable in a first direction to carry a developer to a developing zone to develop the electrostatic latent image and rotatable in a second direction opposite to the first direction for a predetermined period when the latent image is not being developed;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, wherein the developer is supplied to said developer carrying member in said container at a position downstream of a position where a magnetic force is minimum between said first and second magnetic poles, with respect to the first direction, whereby during rotation of said developer carrying member in the first direction, the developer having passed through the developing zone is removed from said developer carrying member by means of a repelling magnetic force formed between said first and second magnetic poles, and whereby during rotation of said developer carrying member in the second direction, the developer on said developer carrying member is removed from said developer carrying member by means of the repelling magnetic force so that the developer is not carried to the developing zone.

2. An apparatus according to claim 1, further comprising a regulating member, faced to said developer carrying member with a gap, for regulating a layer thickness of the developer to be carried to the developing zone, wherein said magnet has a third magnetic pole upstream of said regulating member and downstream of the second magnetic pole with respect to the first direction, and a fourth magnetic pole adjacent to said third magnetic pole and a downstream of said regulating member, and wherein the third and fourth magnetic poles are opposite in the polarity.

3. An apparatus according to claim 1, wherein said container is provided with stirring means for stirring the developer removed from said developer carrying member by means of the repelling magnetic force.

4. An apparatus according to claim 2, wherein said developer carrying member rotates in the second direction for a predetermined period of time after completion of development of the electrostatic latent image.

5. An apparatus according to claim 4, wherein said developer carrying member rotates in the second direction for a second predetermined period of time before start of formation of the electrostatic latent image.

6. An apparatus according to claim 5, wherein said developer carrying member rotates in the second direction for a second predetermined period of time before start of movement of said image bearing member.

7. An apparatus according to claim 1 or 2, further comprising a bias voltage source for applying to said developer carrying member a bias voltage for forming an alternating electric field in the developing zone at least during development operation of the latent image.

8. An apparatus according to claim 7, further comprising means for stopping application of the bias voltage to said developer carrying member during a period of non-developing-operation containing rotation of said developer carrying member in the second direction.

9. An apparatus according to claim 1 or 2, wherein a magnetic brush of the developer is formed and is contacted to said image bearing member in the developing zone during the developing operation.

10. An apparatus according claim 9, further comprising a bias voltage source for applying a bias voltage to said developer carrying member to form an alternating electric field across the developing zone at least during the developing operation.

11. An apparatus according to claim 10, further comprising means for stopping application of the bias voltage to said developer carrying member during the period of non-developing-operation containing rotation of said developer carrying member in the second direction.

12. An image forming apparatus, comprising:

a movable image bearing member;

means for forming an electrostatic latent image on said image bearing member; and a plurality of developing means for developing the latent images formed by said image forming means, wherein when one of said developing means develops the latent image, the remaining developing means are not operated, each said developing means comprising:

a developer carrying member rotatable in a first direction to carry a developer to a developing zone to develop the electrostatic latent image and rotatable in a second direction opposite to the first direction for a predetermined period when it does not develop the latent image;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, and the developer is supplied to said developer carrying member in said container at a position downstream of a position where a magnetic force is minimum between said first and second magnetic poles, with respect to the first direction, whereby during rotation of said developer carrying member in the first direction, the developer having passed through the developing zone is removed from said developer carrying member by means of a repelling magnet force formed between said first and second magnetic poles, and whereby during rotation of said developer carrying member in the second direction, the developer on said developer carrying member is removed from said developer carrying member by means of the repelling magnetic force so that the developer is not carried to the developing zone.

13. An apparatus according to claim 12, wherein said developing means each further comprising a regulating member, faced to said developer carrying member with a gap, for regulating a layer thickness of the developer to be carried to the developing zone, wherein said magnet has a third magnetic pole upstream of said regulating member and downstream of the second magnetic pole with respect to the first direction, and a fourth magnetic pole adjacent to said third magnetic pole and downstream of said regulating member, and wherein the third and fourth magnetic poles are opposite in the polarity.

14. An apparatus according to claim 13, wherein said container is provided with stirring means for stirring the developer removed from said developer carrying member by means of the repelling magnetic force.

15. An apparatus according to claim 13, wherein said developer carrying member rotates in the second direction for a predetermined period of time after completion of development of the electrostatic latent image.

16. An apparatus according to claim 15, wherein said developer carrying member rotates in the second direction for a second predetermined period of time before start of formation of the electrostatic latent image.

17. An apparatus according to claim 16, wherein said developer carrying member rotates in the second direction for a second predetermined period of time before start of movement of said image bearing member.

18. An apparatus according to claim 12 or 13, further comprising a bias voltage source for applying a periodically changing bias voltage to said developer carrying member of each of said developing means.

19. An apparatus according to claim 12 or 13, wherein a magnetic brush of the developer of each of said developing devices is contacted to said image bearing member in its developing zone during its developing operation.

20. An apparatus according to claim 19, further comprising a bias voltage source for applying a periodically changing bias voltage to said developer carrying member of each of said developing means.

21. An image forming apparatus, comprising:

a movable image bearing member;

means for forming an electrostatic latent image on said image bearing member; and developing means for developing the latent image, said developing means comprising:

a developer carrying member rotatable in a first direction to carry a developer to a developing zone to develop the electrostatic latent image and rotatable in a second direction opposite to the first direction for a predetermined period when the latent image is not being developed;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, wherein the developer is supplied to said developer carrying member in said container at a position downstream of a position where a magnetic force is minimum between said first and second magnetic poles, with respect to the first direction, whereby during rotation of said developer carrying member in the first direction, the developer having passed through the developing zone is removed from the developer carrying member by means of a repelling magnetic force formed between said first and second magnetic poles, and whereby during rotation of said developer carrying member in the second direction, the developer on said developer carrying member carried toward the developing zone is removed from said developer carrying member by means of the repelling magnetic force, wherein said developer carrying member rotates in the second direction for a predetermined period of time after completion of development of the electrostatic latent image and rotates in the second direction for a second predetermined period of time before start of formation of the electrostatic latent image.

22. An image forming apparatus, comprising:

a movable image bearing member;

means for forming an electrostatic latent image on said image bearing member; and a plurality of developing means for developing the latent images formed by said image forming means, wherein when one of said developing means develops the latent image, the remaining developing means are not operated, each said developing means comprising:

a developer carrying member rotatable in a first direction to carry a developer to a developing zone to develop the electrostatic latent image and rotatable in a second direction opposite to the first direction for a predetermined period when it does not develop the latent image;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, and the developer is supplied to said developer carrying member in said container at a position downstream of a position where a magnetic force is minimum between said first and second magnetic poles, with respect to the first direction;

whereby during rotation of said developer carrying member in the first direction, the developer having passed through the developing zone is removed from said developer carrying member by means of a repelling magnetic force formed between said first and second magnetic poles, and whereby during rotation of said developer carrying member in the second direction, the developer on said developer carrying member being carried toward the developing zone is removed from said developer carrying member by means of the repelling magnetic force, wherein said developer carrying member rotates in the second direction for a predetermined period of time after completion of development of the electrostatic latent image and rotates in the second direction for a second predetermined period of time before start of formation of the electrostatic latent image.

23. An image forming apparatus, comprising:

a movable image bearing member;

means for forming an electrostatic latent image on said image bearing member; and developing means for developing the latent image, said developing means comprising:

a developer carrying member rotatable in a first direction to carry a developer to a developing zone to develop the electrostatic latent image and rotatable in a second direction opposite to the first direction for a predetermined period when the latent image is not being developed;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, wherein the developer is supplied to said developer carrying member in said container at a position downstream of a position where a magnetic force is minimum between said first and second magnetic poles, with respect to the first direction, whereby during rotation of said developer carrying member in the first direction, the developer having passed through the developing zone is removed from the developer carrying member by means of a repelling magnetic force formed between said first and second magnetic poles, and whereby during rotation of said developer carrying member in the second direction the developer on said developer carrying member is removed from said developer carrying member by means of the repelling magnetic force so that it is not carried to the developing zone, and wherein said developer carrying member rotates in the second direction for a predetermined period of time before start of formation of the electrostatic latent image.

24. An image forming apparatus, comprising:

a movable image bearing member;

means for forming an electrostatic latent image on said image bearing member; and a plurality of developing means for developing the latent images formed by said image forming means, wherein when one of said developing means develops the latent image, the remaining developing means are not operated, each said developing means comprising:

a developer carrying member rotatable in a first direction to carry a developer to a developing zone to develop the electrostatic latent image and rotatable in a second direction opposite to the first direction for a predetermined period when it does not develop the latent image;

a stationary magnet disposed in said developer carrying member, wherein said magnet has a first magnetic pole and a second magnetic pole having the same magnetic polarity at positions downstream of the developing zone with respect to the first direction, and wherein said first and second magnetic poles are disposed adjacent to each other, with said second magnetic pole being disposed downstream of said first magnetic pole with respect to the first direction; and a container for containing the developer to be carried out of said container by rotation of said developer carrying member in the first direction, and the developer is supplied to said developer carrying member in said container at a position downstream of a position where a magnetic force is minimum between said first and second magnetic poles, with respect to the first direction;

whereby during rotation of said developer carrying member in the first direction, the developer having passed through the developing zone is removed from said developer carrying member by means of a repelling magnetic force formed between said first and second magnetic poles, and whereby during rotation of said developer carrying member in the second direction, the developer on said developer carrying member is removed from said developer carrying member by means of the repelling magnetic force so that it is not carried to the developing zone, and wherein said developer carrying member rotates in the second direction for a predetermined period of time before start of formation of the electrostatic latent image.

* * * * *

UNITED STATES PATENT AND TRADEMARK OFFICE

CERTIFICATE OF CORRECTION

PATENT NO. : 5,036,364

DATED : July 30, 1991

INVENTOR(S) : YOSHIHIRO MURASAWA

It is certified that error appears in the above-identified patent and that said Letters Patent is hereby corrected as shown below:

ON THE TITLE PAGE

IN [30] FOREIGN APPLICATION PRIORITY DATA

"Jul. 22, 1988 [JP] Japan ..... 63-18249" should read --Jul. 22, 1988 [JP] Japan ..... 63-182849--.

COLUMN 1

Line 27, "microns of" should read --microns to--.
Line 34, "thin layer" should read --thin layer,--.

COLUMN 2

Line 43, "these principal" should read --the principal--.
Line 44, "invention to" should read --invention is to--.
Line 53, "a" should be deleted.

COLUMN 3

Line 66, "5 functions" should read --6 functions--.

COLUMN 5

Line 16, "degrees" should read --90 degrees--.
Line 66, "developing 5" should read --developing--.

COLUMN 6

Line 5, "not," should read --not--.

UNITED STATES PATENT AND TRADEMARK OFFICE

CERTIFICATE OF CORRECTION

PATENT NO. : 5,036,364

DATED : July 30, 1991

INVENTOR(S) : YOSHIHIRO MURASAWA

It is certified that error appears in the above-identified patent and that said Letters Patent is hereby corrected as shown below:

COLUMN 7

Line 9, "detailed 5 description" should read --detailed description--.
Line 52, "to develop the second latent image" should be deleted.

COLUMN 9

Line 50, "a" should be deleted.
Line 65, "claim 5," should read --claim 5 or 21,--.

COLUMN 11

Line 28, "claim 16," should read --claim 16 or 22,--.

Signed and Sealed this

Eighth Day of June, 1993

Attest:

Michael K. Kirk

MICHAEL K. KIRK

Attesting Officer

Acting Commissioner of Patents and Trademarks